US005423595A

United States Patent [19]

Hancock

[11] Patent Number: 5,423,595

[45] Date of Patent: Jun. 13, 1995

[54] ADJUSTMENT MECHANNISM FOR LOCKING RELATIVELY MOVABLE PARTS OF FURNITURE

[75] Inventor: Steven W. Hancock, Wexford, Ireland

[73] Assignee: Ashfield Engineering Company Wexford Limited, Wexford, Ireland

[21] Appl. No.: 197,354

[22] Filed: Feb. 17, 1994

Related U.S. Application Data

[63] Continuation of Ser. No. 835,612, Feb. 13, 1992, abandoned.

[30] Foreign Application Priority Data

Feb. 15, 1991 [IE] Ireland ..... 526/91
May 21, 1991 [IE] Ireland ..... 1724/91

[51] Int. Cl.[6] ..... A47C 1/027

[52] U.S. Cl. ..... 297/374; 297/302; 297/328; 188/167

[58] Field of Search ..... 294/374–376, 294/300–306, 328; 188/166, 167

[56] References Cited

U.S. PATENT DOCUMENTS

| | | | |
|---|---|---|---|
| 1,818,334 | 8/1931 | Kazenmaier | 188/167 |
| 4,062,587 | 12/1977 | Wolters . | |
| 4,364,605 | 12/1982 | Meiller | 297/306 |
| 4,392,686 | 7/1983 | Beer | 297/376 |
| 4,636,004 | 6/1987 | Neomüller | 297/374 |
| 4,639,514 | 9/1987 | Völkle | 297/374 |
| 5,066,069 | 11/1991 | DeGelder | 297/374 |

FOREIGN PATENT DOCUMENTS

| | | | |
|---|---|---|---|
| 0022225 | 1/1981 | European Pat. Off. . | |
| 0265782 | 5/1988 | European Pat. Off. . | |
| 0394784 | 10/1990 | European Pat. Off. . | |
| 0045925 | 2/1992 | European Pat. Off. . | |
| 3409593 | 11/1984 | Germany . | |
| 3513333 | 10/1986 | Germany | 297/374 |
| 302349 | 12/1954 | Switzerland | 297/306 |
| 2103079 | 2/1983 | United Kingdom . | |
| 2193884 | 2/1988 | United Kingdom . | |
| 2207043 | 1/1989 | United Kingdom . | |
| 8500734 | 2/1985 | WIPO . | |
| 8600508 | 1/1986 | WIPO . | |
| 9000871 | 2/1990 | WIPO . | |
| 9014031 | 11/1990 | WIPO . | |

*Primary Examiner*—Flemming Saether
*Attorney, Agent, or Firm*—Scully, Scott, Murphy & Presser

[57] ABSTRACT

An adjustment mechanism (1) is disclosed which has a locking assembly (2) and an actuator (3). The locking assembly (2) is self-contained because it is biased by a spring (12) which acts between a housing (11) for the assembly and clutch leaves (5(*a*), 5(*b*)). The actuator (3) has a cam rod (15) which does not take any part in the clamping action on the leaves (5(*a*), 5(*b*)). There is a large mechanical advantage in the actuator (3) because the cam surface (17) is formed from a cut-out in the rod (15). A single actuator (45) may be used for two or more locking assemblies. Depending on configuration of the cam surfaces (48, 49), exclusive operation of one locking assembly may be achieved.

4 Claims, 5 Drawing Sheets

ADJUSTMENT MECHANNISM FOR LOCKING RELATIVELY MOVABLE PARTS OF FURNITURE

This is a continuation of application Ser. No. 835,612, filed on Feb. 13, 1992 now abandoned.

BACKGROUND OF THE INVENTION.

Introduction

The invention relates to an adjustment mechanism for furniture, and in particular furniture having at least two parts whose relative position may be adjusted and locked. One example is a swivel chair in which a seat and a backrest are movable with respect to each other, and in which the seat may in turn be movable with respect to a fixed support on a spindle. Another example is a "scissors" height adjustment mechanism for a collapsible table, or a pivotable height adjustment mechanism for computer furniture.

Prior Art

At present, such adjustment mechanisms generally comprise a locking device which is usually a friction clutch. European Patent Specification No. 0,394,784 (Lineager) and PCT Patent Specification No. 86/00508 (Volkle) describe adjustment mechanisms for swivel chairs. In both of these mechanisms, there is a biasing spring which acts between a friction clutch and a cam at the end of a handle protruding from the mechanism. To disengage the clutch, the cam is rotated using the handle to release pressure of the spring on the friction clutch to allow movement of the various parts. Problems with this arrangement include the fact that the cam and handle arrangement is bulky, for example, in EP 0,394,784 the spring and cam arrangement protrudes outside of a channel which encloses the clutch and other of the adjustment mechanism. Because they are bulky, it appears they would be relatively expensive to manufacture. Another significant disadvantage is that pressure from the spring acting on the friction clutch also acts on the cam and handle which are used for operation of the friction clutch. These stresses are in turn transmitted from the cam and handle to the housing for the adjustment mechanism. Accordingly, there would be significant wear on the mechanisms because of the effects of the stress.

European Patent Specification No. 0,045,925 (Steifensand) also discloses an adjustment mechanism for a chair. In this case a threaded spindle is used to clamp the leaves of the friction clutch together. Again, stresses would be transmitted from the friction clutch, through the spindle and into various other parts of the mechanism.

British Patent Specification No. GB 2,193,884 (Chair Mechanisms Limited) describes an adjustment mechanism for a chair which is less bulky than those referred to above. In this case, the friction clutch is clamped in the engaged position by a transversely mounted clamp which is acted upon by a torsion spring. However, the significant disadvantage remains that spring pressure is transmitted through the housing of the mechanism, again leading to reliability problems and more costly construction requirements.

Another disadvantage of presently available adjustment mechanisms for furniture generally is that if there is more than one locking device for relatively movable parts, each must have an associated clamp, cam or threaded spindle arrangement for operation of the clutch. This leads to a requirement for a large number of parts and for a large size and costly manufacture.

OBJECTS OF THE INVENTION

It is an object of the present invention to provide an adjustment mechanism for furniture which requires relatively few parts and which is more compact than existing mechanisms. Another requirement is that the mechanism be relatively simple to manufacture. A still further object is that there be relatively little stress throughout the mechanism, leading to greater reliability.

SUMMARY OF THE INVENTION

The invention provides an adjustment mechanism for relatively movable parts of a furniture article, the mechanism having a locking assembly which is self-locking and a separate actuator which has no function in the locked position of the locking assembly. The locking assembly comprises a locking device for connection between the parts, and a biasing unit acting between a fixed anchorage in the assembly and the locking device to hold it in a normally-locked position.

In a preferred embodiment, the actuator comprises a cam rotatable within an external bearing and having a cam surface for engagement with the biasing unit.

According to another aspect, the invention provides a locking assembly for a furniture adjustment mechanism, the assembly comprising a housing, a locking device, and a biasing unit. The biasing unit acts between the housing and the locking device to hold it in a normally-locked position so that the assembly is self-locking.

The invention will be more clearly understood from the following description of some preferred embodiments thereof, given by way of example only, with reference to the accompanying drawings in which.

DETAILED DESCRIPTION OF THE INVENTION

Figure 1:
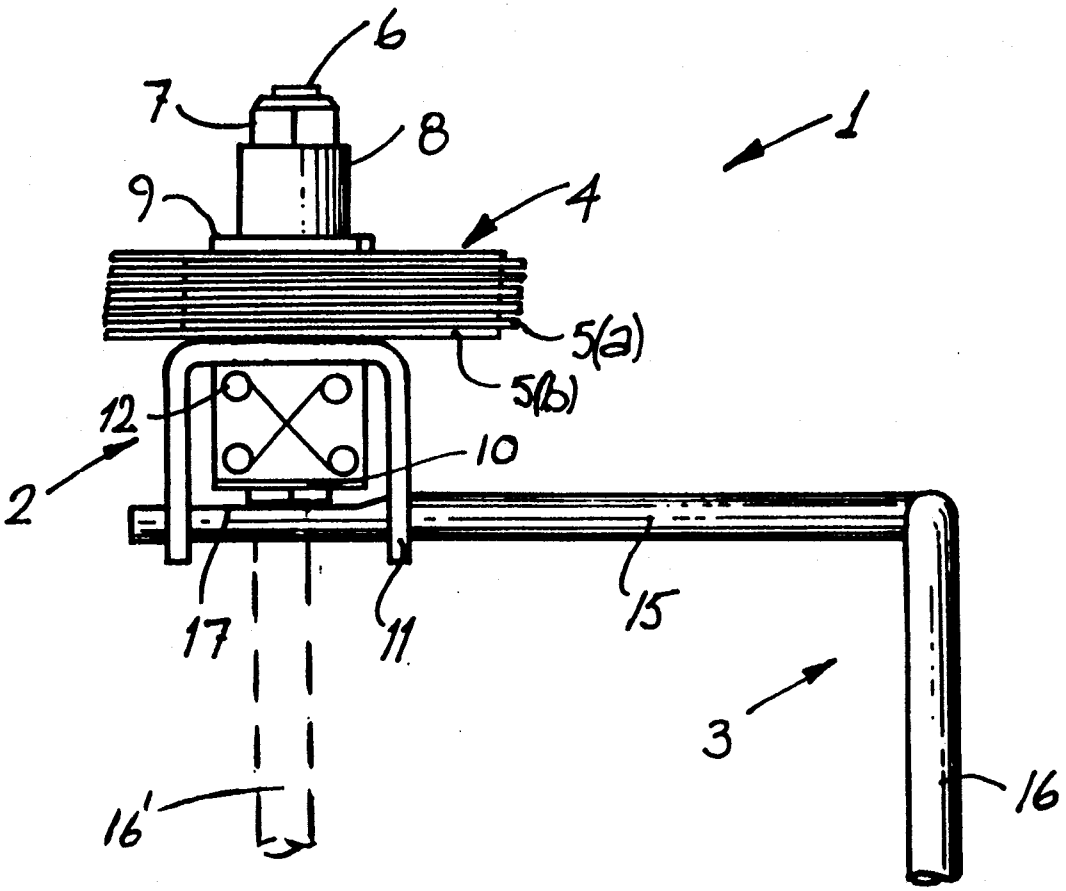
FIG. 1 is a plan view of an adjustment mechanism of the invention.

Referring to the drawings, and initially to FIG. 1, there is illustrated an adjustment mechanism of the invention indicated generally by the reference numeral 1. The adjustment mechanism 1 is for furniture and may be used to allow adjustment of two or three relatively movable parts of an item of furniture, as described below. The mechanism 1 comprises a locking assembly 2 and an actuator 3. The locking assembly 2 comprises a locking device, namely, a friction clutch 4 having two sets of friction leaves 5(*a*) and 5(*b*). A bolt 6 protrudes through slots in the leaves 5(*a*) and 5(*b*) and at its outer end it carries a nut 7, on the inside of which there is a sleeve 8, and on the inside of which there is a washer 9 engaging the leaves 5(*a*) and 5(*b*). The bolt 6 also protrudes through an aperture in a channel-shaped housing 11 of the assembly 2, within which there is a biasing unit, namely, a coil spring 12. The spring 12 is mounted between the housing 11 and the head of the bolt 6. It thus acts between a fixed anchorage (the housing 11) and the clutch 4 (via the bolt 6, nut 7, sleeve 8 and the washer 9).

The spring 12 is in compression and urges the head of the bolt 6 away from the clutch leaves 5(*a*) and 5(*b*), and hence the washer 9 is urged against the leaves to hold them in position. Thus, the clutch 4 is normally engaged by the action of the spring 12. The locking assembly 2 is self-locking because the spring 12 acts between the clutch 4 and its housing 11. Once the clutch is engaged, the bolt 6 does not move under the action of the spring 12 because the friction leaves 5(*a*) and 5(*b*) are clamped in the maximum extent for that spring pressure. Thus, the locking assembly 2 may be simply inserted into a channel or other housing for an adjustment mechanism without imparting stress on any other parts.

The adjustment mechanism 1 is completed by the actuator 3 which has a cam, namely, a rod 15 inserted through external bearings, namely, aligned apertures (not shown) in the housing 11. A handle 16 is connected at the end of the rod 15. At its extremity, the rod 15 has a cut-out which forms a vertical cam surface 17.

Rotation of the handle 16 into or out of the plane of the page causes the rod 15 to rotate and thus the cam surface 17 contacts the head of the bolt 6 and further rotation compresses the spring 12 and releases pressure on the friction leaves 5(*a*) and 5(*b*). Thereafter, furniture parts connected to the leaves 5(*a*) and 5(*b*) may be moved in relation to one another because the leaves are free to move. When the new relative position of the parts has been set, the handle 16 is simply released to allow the spring 12 to cause the washer 9 to clamp the leaves at the new position.

The cam of the actuator need not necessarily be a rod such as the rod 15. It is envisaged that the cam may be much shorter, for example, extending only between the ends of the housing 11. In this case, a handle such as the handle 16' shown by interrupted lines could be used.

Because the spring 12 acts between the housing 11 and the clutch 4, no stress is transmitted outside of the locking assembly 2. The actuator 3 is functionally separate while the clutch 4 is locked. Accordingly, there is much less stress in the mechanism than has heretofore been the case. The advantages arising from this include the fact that lighter and less costly materials may be used, and that reliability is improved because there is no wear on the parts outside of the locking assembly for the vast majority of the life of the mechanism. Another very important advantage is that the locking assembly may be assembled and mounted in a mechanism in a modular manner, greatly improving production efficiency.

Another important aspect of the invention is that because the actuator includes a cam rotatable in external bearings, and because the cam surface is formed from a cut-out in the cam rod 15, there is a very large mechanical advantage between movement of the handle 16 and movement of the engagement surface 17. Thus, very little movement of the handle 16 is required for disengagement of the clutch 4. Indeed, it is envisaged that a press-in button mechanism could be used instead of a rotatable handle.

Figure 2:
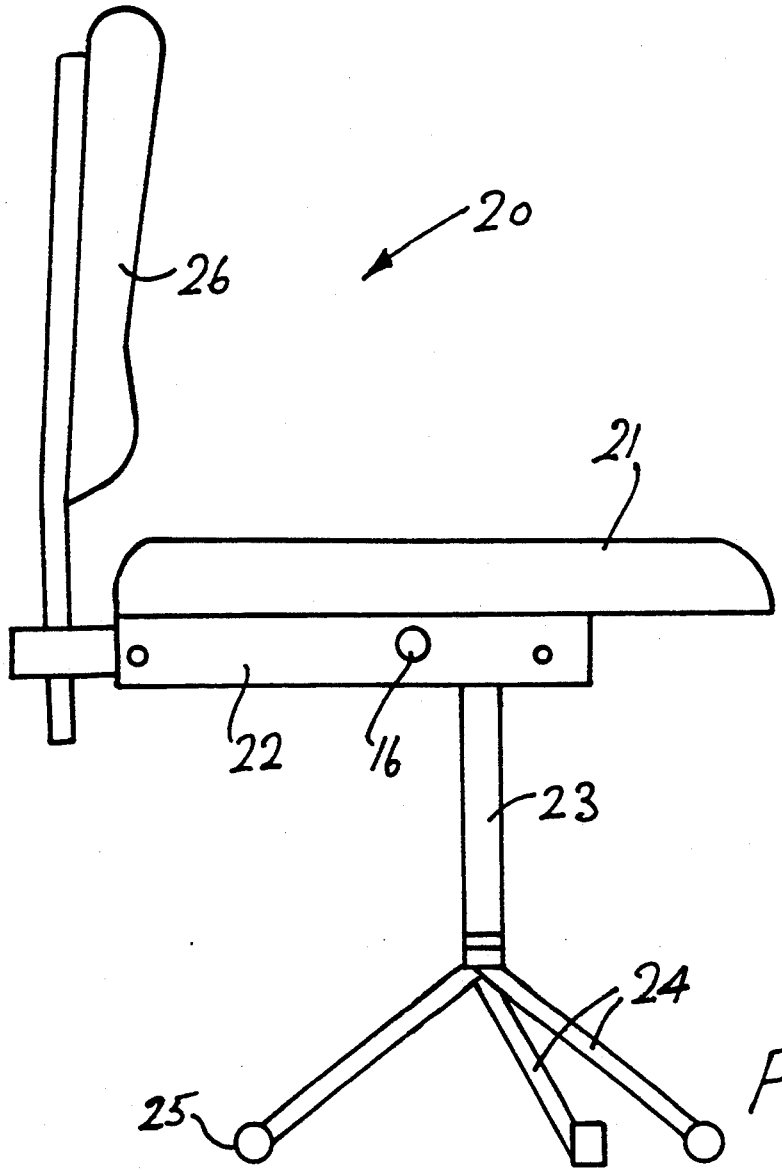
FIG. 2 is a side view of a swivel chair which incorporates an adjustment mechanism of the invention.

Referring now to FIGS. 2 to 5, application of the invention to adjustment of a swivel chair is illustrated. In FIG. 2 there is illustrated a swivel chair 20 having a seat 21 supported by a seat support 22. The seat 20 also has a fixed spindle 23 having legs 24 on casters 25. A backrest 26 is pivotally connected to the seat support 22.

Figure 5:
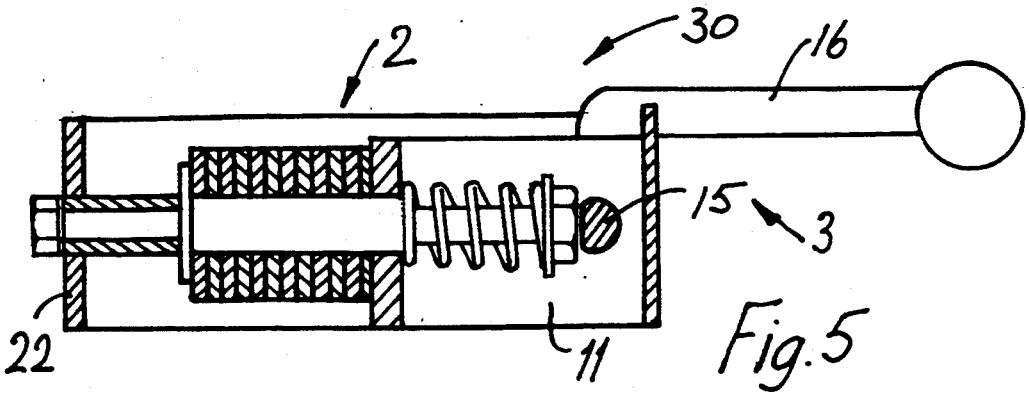
FIG. 5 is a cross-sectional view along the lines V—V of FIG. 3.
Figures 3, 4:
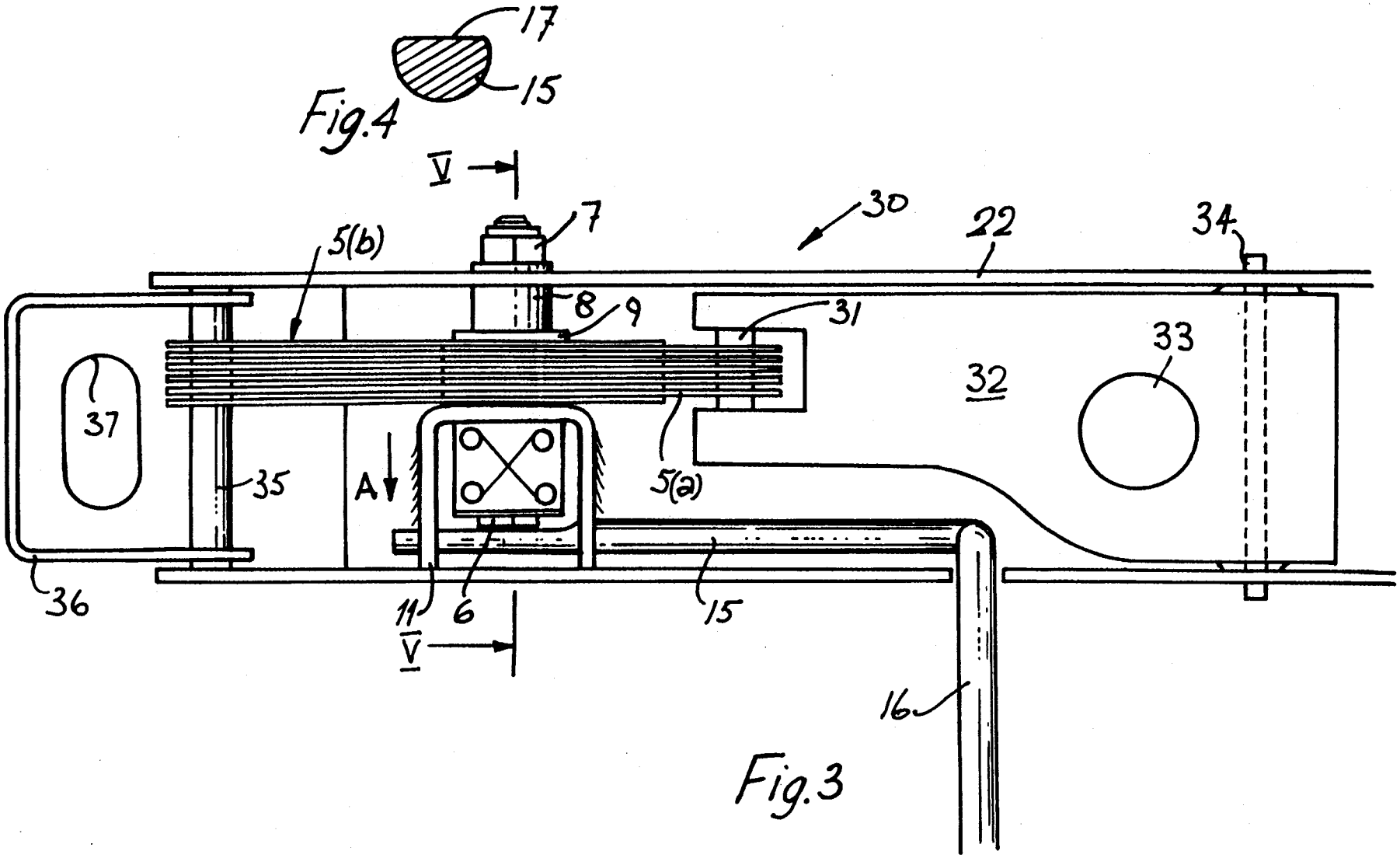
FIG. 3 is a plan view of an adjustment mechanism for the chair of FIG. 2.
FIG. 4 is a cross-sectional view of an actuator rod used in the mechanism.

Referring specifically to FIGS. 3, 4 and 5, a chair adjustment mechanism 30 which includes the seat support 22 is described. For clarity, parts similar to those described with reference to FIG. 1 are identified by the same reference numerals. A pin 31 is inserted through the ends of the clutch leaves 5(*a*), the pin 31 being on a fixed support 32 secured to the spindle 23 at an aperture 33. The seat support 22 is a channel-shaped member which is pivotally connected to the fixed support 32 by a pivot pin 34. The housing 11 of the locking assembly 2 is welded to the seat support 22. Finally, the clutch leaves 5(*b*) are connected to a pin 35 in a backrest support 36 having an aperture 37 for reception of the stem of the backrest 26. The backrest support 36 is pivotally connected to the seat support 22 directly below the pin 35, and thus is not illustrated. Thus, the locking assembly 2 is fixed to the seat support 22, and the fixed support 32 and the backrest support 36 are movable in relation to it. In FIG. 4 there is shown a cross-sectional view of the rod 15 at the locking assembly 2. The view of FIG. 5 clearly shows the manner in which the cam surface 17 of the rod 15 engages the bolt 6 to release clamping pressure on the friction leaves 5(*a*) and 5(*b*) on rotation of the handle 16.

In use, the action of the spring 12 causes the friction leaves 5(*a*) and 5(*b*) to be clamped together and thus, the fixed support 32, the seat support 22 and the backrest support 36 are fixed in relative position. Effectively, the backrest support 36 is fixed in relation to the seat support, which is in turn fixed in relation to the fixed support 32. When it is desired to adjust the seat and the backrest, the handle 16 is pulled either upwardly or downwardly, causing the cam surface 17 to engage the bolt 6, causing the spring 12 to be compressed, releasing pressure on the clutch 4 and allowing the various parts to be moved in relation to one another. When the desired position is reached, one lets go the handle 16 allowing the spring to expand and engage the clutch 4.

It will be appreciated that the chair adjustment mechanism 30 is extremely compact and has few parts. Stresses are not transmitted to the actuator 3 because it is just beyond the bolt 6 and thus, the seat support 32 is not required to handle stresses. Manufacture of the chair adjustment mechanism 30 is relatively simple because the locking assembly may be simply inserted in the seat support 22 and thereafter, the leaves connected to the various pins and the handle 11 welded to the channel. Thus, because the locking assembly is self-contained, not only are stresses not transmitted to the other parts of the adjustment mechanism, but assembly may be carried out in a modular fashion.

Figures 6, 7, 8:
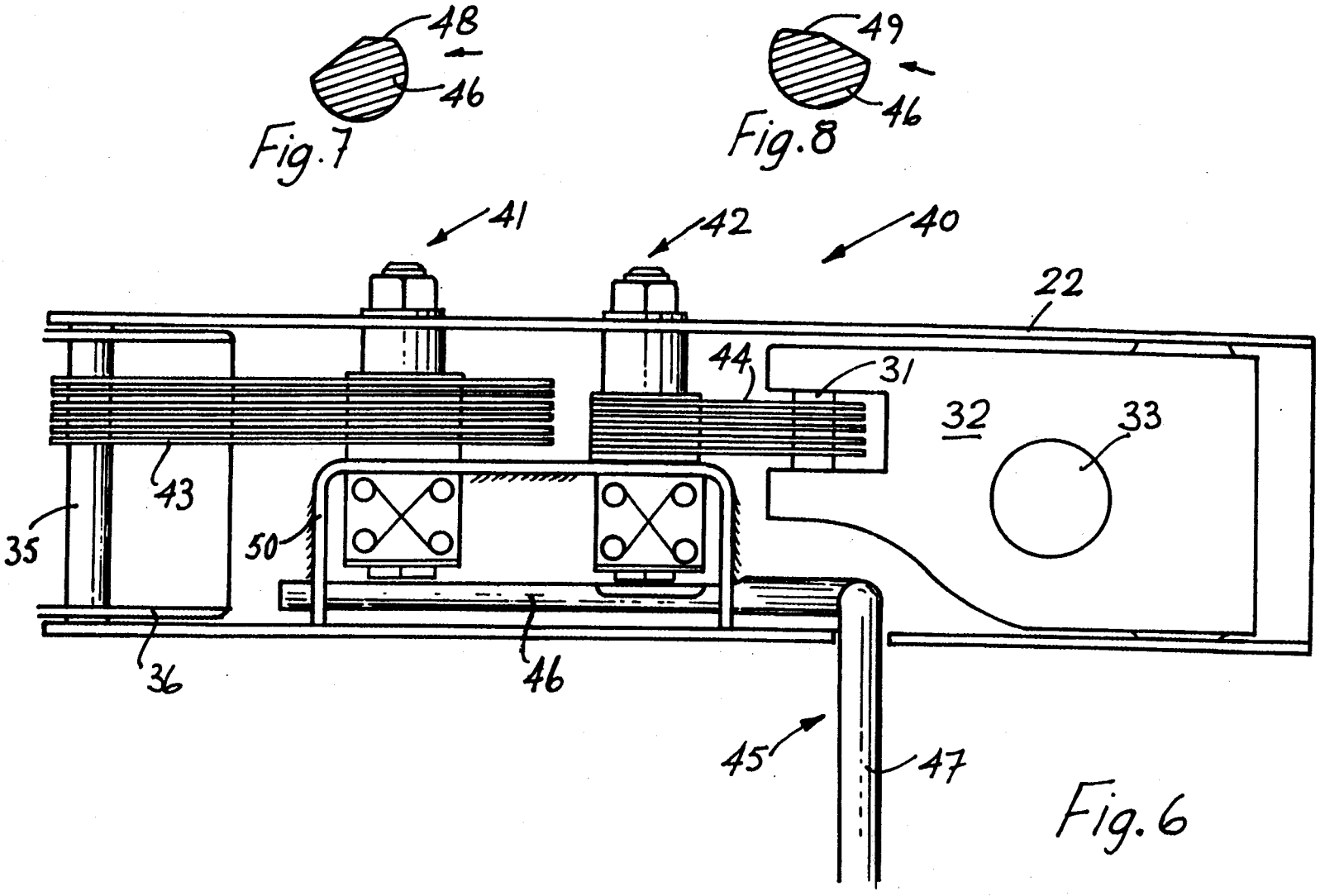
FIG. 6 is a plan view of an alternative construction of chair adjustment mechanism.
FIGS. 7 and 8 are different cross-sectional views of an actuator rod for use with the mechanism of FIG. 6.

Referring now to FIGS. 6, 7 and 8, another important aspect of the invention is illustrated. In FIG. 6 there is illustrated a chair adjustment mechanism 40 having two locking assemblies 41 and 42 having friction leaves 43 and 44, respectively. Parts similar to those described with reference to the previous drawings are identified by the same reference numerals. Because there are two locking assemblies 41 and 42, independent adjustment of the seat support in relation to the fixed support and of the backrest support in relation to the seat support is possible. However, to achieve this, there is no need for two actuating mechanisms and instead an actuator 45 having a rod 46 and a handle 47 is used. The rod 46 is mounted in external bearings formed by aligned apertures in a housing 50 of the locking assemblies 41 and 42. The rod 46 is machined at the position of the locking assembly 41 as shown in FIG. 7 and at the position of the locking assembly 42 as shown in FIG. 8. At the position of the locking assembly 41 there is a cam surface 48 which is similar to the upper portion of the cam surface 17. However, below the cam surface 48, the rod 46 is tapered. On the contrary, at the position next to the locking assembly 42, the lower part of the rod 46 has a cam surface 49, the upper part being tapered. Thus, rotation of the handle 47 upwardly (out of the plane of the page) causes the cam engagement surface 48 to rotate and disengage the locking assembly 41. However, because of the tapered portion next to the locking assembly 42, this direction of rotation of the rod 46 does not result in its engagement with the assembly 42. Accordingly, upward movement of the handle 47 allows adjustment of the backrest with respect to the seat, while the seat remains fixed in relation to the spindle. On the contrary, when the handle 47 is moved downwardly, the locking assembly 42 is engaged by the cam surface 49, while the locking assembly 41 is not engaged. This allows adjustment of the seat relative to the spindle, while the backrest remains fixed in relation to the seat. Thus, by using an actuator which has a rod mounted transversely of the locking assemblies and which itself does not exert pressure on the assemblies (which are self-contained), action of the actuator on the mechanism is different for different directions of rotation of the handle 47. This considerably simplifies the control of multi-locking device adjustment mechanisms. Needless to say, the chair adjustment mechanism 40 also has all of the other advantages mentioned for the mechanisms described above.

It is envisaged that any desired configuration of cam surface and tapered surface may be used to achieve the desired actuation. For example, one cam surface may be like the surface 17, the other like the surface 48, so that rotation of the handle in one direction releases both clutches, and in the other direction only one clutch. The invention thus provides complete versatility in locking device control.

Figure 9:
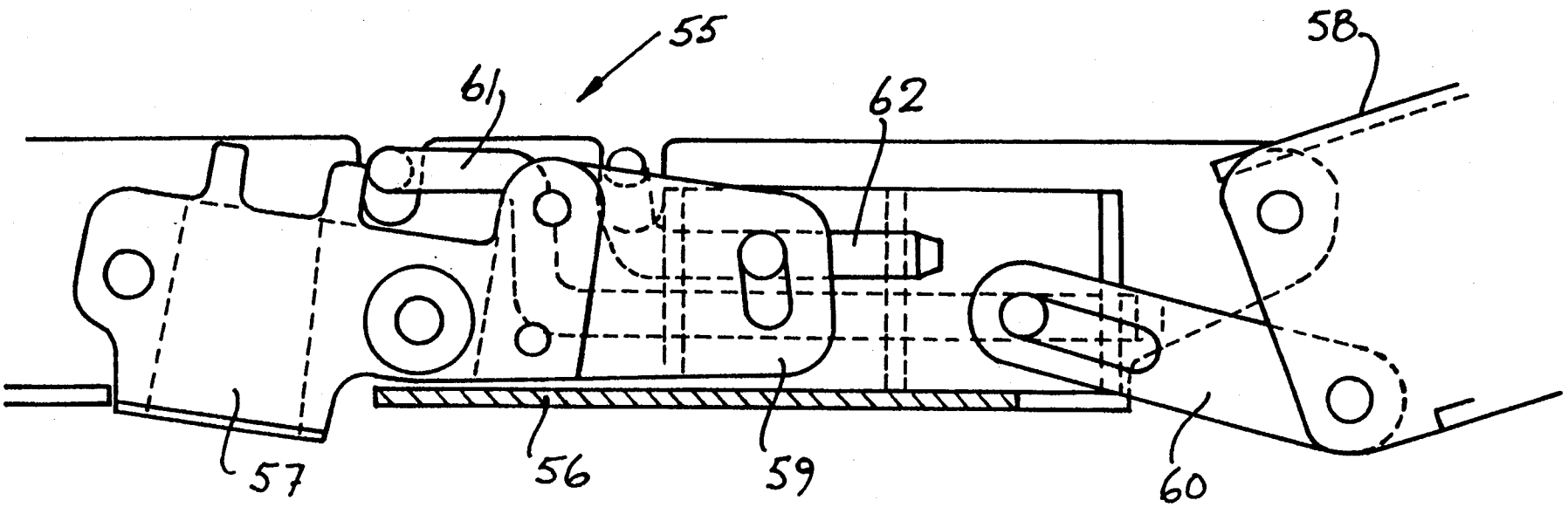
FIG. 9 is a diagrammatic side view of a still further construction of adjustment mechanism of the invention.

Referring now to FIG. 9, there is illustrated a chair adjustment mechanism 55 having a seat support 56, a fixed support 57 and a backrest support 58. There are again two separate locking assemblies, one of which has friction clutch leaves 60 mounted between the backrest support 58 and a seat support 56 and the other of which has leaves 59 mounted between the seat support 56 and the fixed support 57. For clarity, all the parts are not illustrated. The two locking assemblies are controlled by separate actuators 61 and 62. This arrangement illustrates clearly the compactness of the adjustment mechanism of the invention because although there are two locking assemblies in this arrangement and a separate actuator for each locking assembly, all of the parts of the mechanism may be easily contained within a single channel piece.

The invention is not limited to the embodiments hereinbefore described. Although the adjustment mechanism has been primarily illustrated for use with chairs, it will be appreciated that it could be used for any type of furniture adjustment. One example is a scissors arrangement for adjusting height of a table, or of any type of height adjustment mechanism for a table such as a computer table. The advantages of compactness, simplicity, reliability and versatility are achieved irrespective of the use to which the adjustment mechanism is put.

I claim:

1. A chair adjustment mechanism comprising:

a. an elongate channel-shaped support having a base and upstanding side walls, said channel-shaped support extending in a longitudinal direction and being for support of a chair part;

b. at least one support pivotally connected to the channel-shaped support by a pivot connector extending transversely across the support side walls so that the supports are interconnected and relatively movable;

c. a locking assembly connected to and extending transversely with respect to the channel-shaped support and comprising:

an anchorage member connected to and positioned within the channel-shaped support, said anchorage member comprising a transverse plate extending transversely inwardly from one of said side walls and a longitudinal plate connected to said transverse plate at an end opposite said side wall extending in the longitudinal direction of said channel-shaped support;

a locking device mounted for interconnecting and selectively enabling pivotable movement between said relatively movable supports and for locking at least two said relatively movable supports in fixed relationship, said locking device comprising interengagable locking members extending along and within said channel-shaped support between said relatively movable supports; and a biasing unit mounted between the longitudinal plate of the anchorage member and the locking device and holding the locking device in a normally-locked position, the locking device and the biasing unit engaging the anchorage member longitudinal plate on opposed faces so that applied forces at least partially cancel and the biasing stresses are maintained within the locking assembly, with the direction of said applied forces being the direction in which the locking assembly extends, which is transverse with respect to the channel-shaped support, d. an actuator for the locking assembly, the actuator comprising:

a rod mounted to extend longitudinally with respect to the channel-shaped support;

mounting means for mounting the rod in a position adjacent to the biasing unit of the locking assembly, the rod being disengaged from the biasing unit when the locking device is in the normal position, said mounting means comprising a bearing in the transverse plate of the anchorage member;

a flattened cam surface in the rod located with respect to the biasing unit so that on rotation of the rod the cam surface engages the biasing unit to unlock the locking device; and means in the actuator and extending from the channel-shaped support to allow user rotation of the rod.

2. A chair adjustment mechanism as claimed in claim 1, wherein the mounting means for the rod comprises an external bearing formed by the anchorage member transverse plate.

3. A chair adjustment mechanism as claimed in claim 2, wherein the anchorage member has a pair of opposed walls having in-line apertures forming the external bearing for the rod.

4. A chair adjustment mechanism as claimed in claim 3, where the anchorage member is of U-shaped construction and houses the biasing unit.

* * * * *